US005833170A

United States Patent [19]

Molo

[11] Patent Number: 5,833,170

[45] Date of Patent: Nov. 10, 1998

[54] HOLDER FOR PAPER TOWELS

[75] Inventor: Nicholas J. Molo, Kissimmee, Fla.

[73] Assignee: Dart Industries Inc., Orlando, Fla.

[21] Appl. No.: 645,799

[22] Filed: May 16, 1996

Related U.S. Application Data

[63] Continuation of Ser. No. 269,988, Jul. 1, 1994, abandoned.

[51] Int. Cl.[6] ..... B65H 16/06; B65H 16/02; B65H 18/04

[52] U.S. Cl. ..... 242/596.8; 242/591; D6/522

[58] Field of Search ..... 242/591, 596, 242/596.1, 596.8, 598.1, 598.5, 399, 401, 406; D6/522, 523, 519; 312/34.8

[56] References Cited

U.S. PATENT DOCUMENTS

| | | | |
|---|---|---|---|
| D. 154,933 | 8/1949 | Lestage | D4/3 |
| D. 286,118 | 10/1986 | Gecchelin | D6/519 |
| D. 326,580 | 6/1992 | Brazis | D6/522 |
| 1,999,759 | 4/1935 | Hope | 242/596.3 |
| 2,091,311 | 2/1937 | Fischer | 242/596.3 |
| 2,144,757 | 1/1939 | Gilling et al. | 242/596.8 X |
| 4,097,002 | 6/1978 | Krueger | 242/596.8 X |
| 4,105,168 | 8/1978 | Rutherford | 242/596.1 |
| 4,694,559 | 9/1987 | Lundy et al. | 242/596.1 X |

*Primary Examiner*—John Q. Nguyen
*Attorney, Agent, or Firm*—John A. Doninger

[57] ABSTRACT

An elongate base mountable to a support surface by driven fasteners and including opposed end portions which are slidably engaged by brackets on a pair of opposed end supports. The end supports, in addition to the brackets and projecting stub shafts for the mounting of a roll of sheet material, include horizontal shelf surfaces which are maintained horizontally whether the base be mounted on a horizontal or vertical surface.

7 Claims, 4 Drawing Sheets

10
12
14
18
20
22
24
26
28
32
33
34
35
36
37
38
39
40
42
44
46
5

HOLDER FOR PAPER TOWELS

This is a continuation of application Ser. No. 08/269,988 filed on Jul. 1, 1994, now abandoned.

BACKGROUND OF THE INVENTION

Holders for rolls of paper toweling and the like, principally mountable on a vertical wall surface or on a horizontal surface as beneath overhanging kitchen cabinets, normally consist of an elongate generally flat base or bar with a pair of spaced forwardly projecting arms. The arms in turn have lugs in facing opposition to each other which receive the towel roll therebetween.

The arms are either rigidly fixed to the base or pivotally mounted thereon, and at mid-distance between the opposed longitudinal edges of the base.

In at least one instance, note U.S. Pat. No. Des. 286,118, issued Oct. 14, 1986 in the name of Gecchelin, the base has been formed with a full length overlying shelf. This would appear to require a mounting of the Gecchelin device horizontally on a vertical surface.

SUMMARY OF THE INVENTION

The present invention comprises a holder for paper towels and the like utilizing three separately formed substantially rigid components, preferably molded of an appropriate synthetic resin. The components include an elongate mounting base and a pair of end supports which slidably engage with the base and are supported thereby upon a mounting of the base to a support surface by appropriate screws or the like.

The end supports, in addition to providing opposed hubs or stub shafts for reception within the opposed ends of the center core of a paper roll, also provide a backed shelf extending longitudinally beyond each of the opposed ends of the base and the supported roll.

The holder is convertible for mounting either on a vertical surface or an overlying horizontal surface, with the shelves, in each instance, remaining horizontal and usable. The relationship between the elongate base and the end supports is such that an adjustment between vertical and horizontal mounting is effected by reorienting the base without changing the position of the shelf-forming end supports. The reorientation is easily achieved by a longitudinal turning of the base end-for-end, and a transverse rotation of the base 90 degrees. The end supports include angled brackets which slidably engage with the opposed ends of the base in either position thereof for locking in a slidably adjusted position by mounting screws used to secure the base to the support surface.

Providing for the accommodation of the holder on a vertical surface or a horizontal surface in this manner, in addition to maintaining the shelves properly oriented, also enables a positioning of the roll-mounting hubs, as well as the roll itself, in the optimum position, rather than attempting to accommodate, as in the prior art, a situation wherein the entire holder itself must be reoriented.

Other features and advantages of the invention will become apparent from the details of the invention as hereinafter set forth.

DESCRIPTION OF PREFERRED EMBODIMENT

Figure 5:
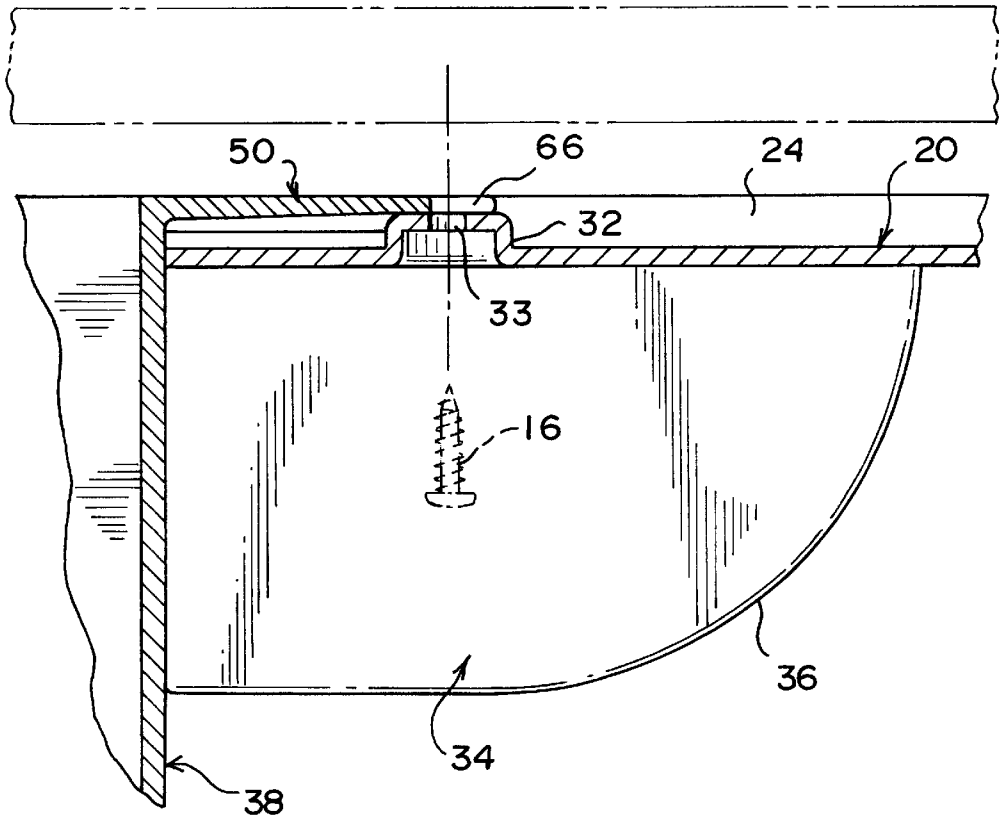
FIG. 5 is an enlarged cross-sectional detail taken substantially on a plane passing along line 5—5 in FIG. 1.

Referring now more specifically to the drawings, the holder for paper towels or similar sheet material is generally designated by reference numeral 10. The holder 10 consists of three components, a central elongate base 12 and two shelf-forming end supports 14. The assembled components, as suggested in FIG. 5, are retained in assembled relationship and simultaneously fixed to a support surface by a pair of fasteners 16, preferably screws.

As will be appreciated from the drawings, the end supports 14 slidably engage with the opposed end portions of the elongate base 12 and are slidably adjustable relative thereto and to each other for accommodating minor differences in the width of a paper roll 18 to be supported therebetween.

The base 12, considering the orientation thereof illustrated in FIGS. 1–7 for engagement with an overhead horizontal surface, comprises an elongate planar top or mounting panel 20. A laterally or upwardly directed flange 22 is integral with the panel 20 along the full length of the linear outer or front edge thereof.

The top panel 20 along the longitudinal inner or rear edge thereof, is provided with a laterally or upwardly projecting integral edge flange 24 centrally therealong and for a major portion of the length of the panel 20. This flange 24 is parallel to and of equal or substantially equal height with the outer flange 22. The rear or inner edge of the panel 20 beyond each of the linear ends of the flange 24, is offset toward the flange 22 and is provided with an integral laterally or upwardly projecting flange 26 which parallels the flange 22 and extends to the respective extreme longitudinal end of the base 12. Each of the flanges 26 is of a lesser height than the flanges 22 and 24. In addition, each of the flanges 26 at the inner end thereof adjacent the corresponding end of the elongate central flange 24, is laterally turned as at 28, to define a longitudinally facing abutment surface. The offset end portions of the inner or rear edge of the panel 20, and the integral flanges 26 thereof, define a pair of rearwardly directed recesses 30, the purpose of which will be described subsequently.

The top mounting panel 20 is provided with a pair of spaced, laterally upwardly offset, apertured bosses 32, with central appertures 33, generally along the longitudinal center line thereof and generally transversely aligned with the turned ends 28 of the flanges 26. As best illustrated in FIG. 5, these bosses 32 are adapted to receive the driven fasteners 18 used to mount the paper towel holder 10. The recesses defined by the bosses will conveniently receive and at least partially conceal the heads of the fasteners.

The base 12 is completed by a pair of rear or inner stabilizing panels 34, each integral with and forming a coplanar continuation of a rear flange 26. The panels 34, for approximately the length of the respective flanges 26, are of equal transverse width with the transverse width of the end portions of the mounting panel 20. The panels 34 extend longitudinally inward of the respective turned inner ends 28 of the flanges 26 and are integral with the undersurface of the panel 20 coplanar with the end portion flanges 26 and laterally inward of the plane of the central flange 24. The panels 34 terminate in longitudinally spaced relation to each other and, as at 36, have the lower and inner edges thereof merging along an arc.

The end units or supports 14 are mirror images of each other, and regardless of whether the holder is mounted on a vertical surface or a horizontal surface, the end supports 14 remain in the vertical orientation illustrated in the drawings. A change in the mounted position of the holder 10 is accomplished solely through a reorientation of the base 12.

Each of the end supports 14 includes an upstanding planar side wall or member 38 with an upper edge 35, a forward edge 37, a rear edge 39 and an inwardly directed surface 40 in facing relation to the inner surface 40 of the second end side wall 38. A planar back or rear wall or member 42, of equal height with each side wall 38, is integrally formed with the rear edge 39 of the wall 38 and extends perpendicularly outward relative thereto. Finally, a planar horizontal, bottom or support wall or member 44, along right-angularly related edges thereof, is integrally joined with and along the lower or bottom of the side and back walls of each of the end supports 14 with each bottom wall 44 supported by the associated side and back walls to define a shelf.

In order to support a roll 18 of paper or the like, a pair of mounting hubs or stub shafts 46 are integrally formed, one on and inwardly projecting from the inner surface 40 of each end wall 38 adjacent the lower forward corner thereof. These hubs 46 are in facing relation to each other and sized for accommodation within the opposed open ends of the core of a roll 18 in a manner which allows for a rolling of the roll for selected discharge of the paper or sheet material.

Each of the end supports mounts to the corresponding end portion of the base 12 by means of a bracket 48 rigid with the corresponding side wall 38 and projecting inwardly from the inner surface 40 at the upper rear corner portion thereof. The bracket 48, in each instance, comprises a pair of right-angularly related top and rear bracket panels 50 and 52. These bracket panels 50 and 52 are integrally molded with the corresponding side wall 38 and project perpendicularly inward from the inner surface 40 thereof to form a first pair of aligned bracket panels 50, 50 and a second pair of aligned bracket panels 52, 52. The top and rear bracket panels 50 and 52 of each end support 14 extend partially along the respective upper and rear edges of the corresponding end wall 38 for a length thereof approximately corresponding to the width of the end portions of the base 12 which are to engage therewith.

The bracket panels 50 and 52 are of the same configuration and have outer faces respectively coplanar with the upper edge of the corresponding side wall 38 and the rear surface of the corresponding rear wall 42. Each of the panels 50 and 52 of each bracket 48 extends from a central corner rib 54 of substantially square cross-section and common to both panels. The outer edge of each bracket panel 50 and 52, parallel to the corner rib 54, has a full length flange 56 therealong. The outer surface of each bracket panel 50 and 52, centrally between the corner rib 54 and the corresponding outer edge flange 56, includes a relatively wide intermediate rib 58 with a planar upper surface, whereby upwardly directed recesses 60 and 62 are formed respectively between the corner rib 54 and the intermediate rib 58, and the outer edge flange 56 and the intermediate rib 58. Each of these recesses in turn includes an upwardly projecting longitudinally extending reinforcing rib 64 tapering from a maximum height and width at the free edge of the respective panel to a minimum height adjacent the fixed end of the bracket panel.

Each intermediate rib 58 of each of the bracket panels 50 and 52 of each bracket 14 includes a central elongate slot or notch 66 extending inward from the free panel edge remote from the corresponding side wall 38 for selective alignment with a corresponding screw-accommodating boss 32 of the base 12, and in particular with the central aperture within the boss.

The inner face of each of the bracket panels 50 and 52 includes elongate reinforcing ribs 68 transversely aligned with corresponding ribs 64 on the outer face and of a constant size corresponding to the outer ends of the ribs 64 along the full length of the panel inner face.

Finally, each of the bracket panels 50 and 52 includes a retaining flange 70 extending along the full length of the inner face of the panel inward from the free edge thereof. The retaining flange 70, also in the nature of an elongate rib, is laterally inwardly spaced from the corner rib 54 or adjacent perpendicular panel and defines a receiving groove 72 therebetween. Noting FIG. 5, the two retaining flanges 70 of these adjacent panels have the free outer edges thereof so spaced as to slidably receive the elongate end portion flanges 26 of the base 12 upon an assembly of the holder as shall be described subsequently.

In assembling the holder 10 for mounting to a horizontal overhead support surface, the base 12 is oriented with the panel 20 horizontal and with the panels 34 to the rear thereof and depending perpendicular therefrom. The end supports 14 are positioned to the opposite ends of the base 12 with the bottom walls 44 horizontal and with the respective side and rear walls extending vertical therefrom. The side walls are in facing relation and the hubs 46 thereon are aligned.

Figures 1, 4:
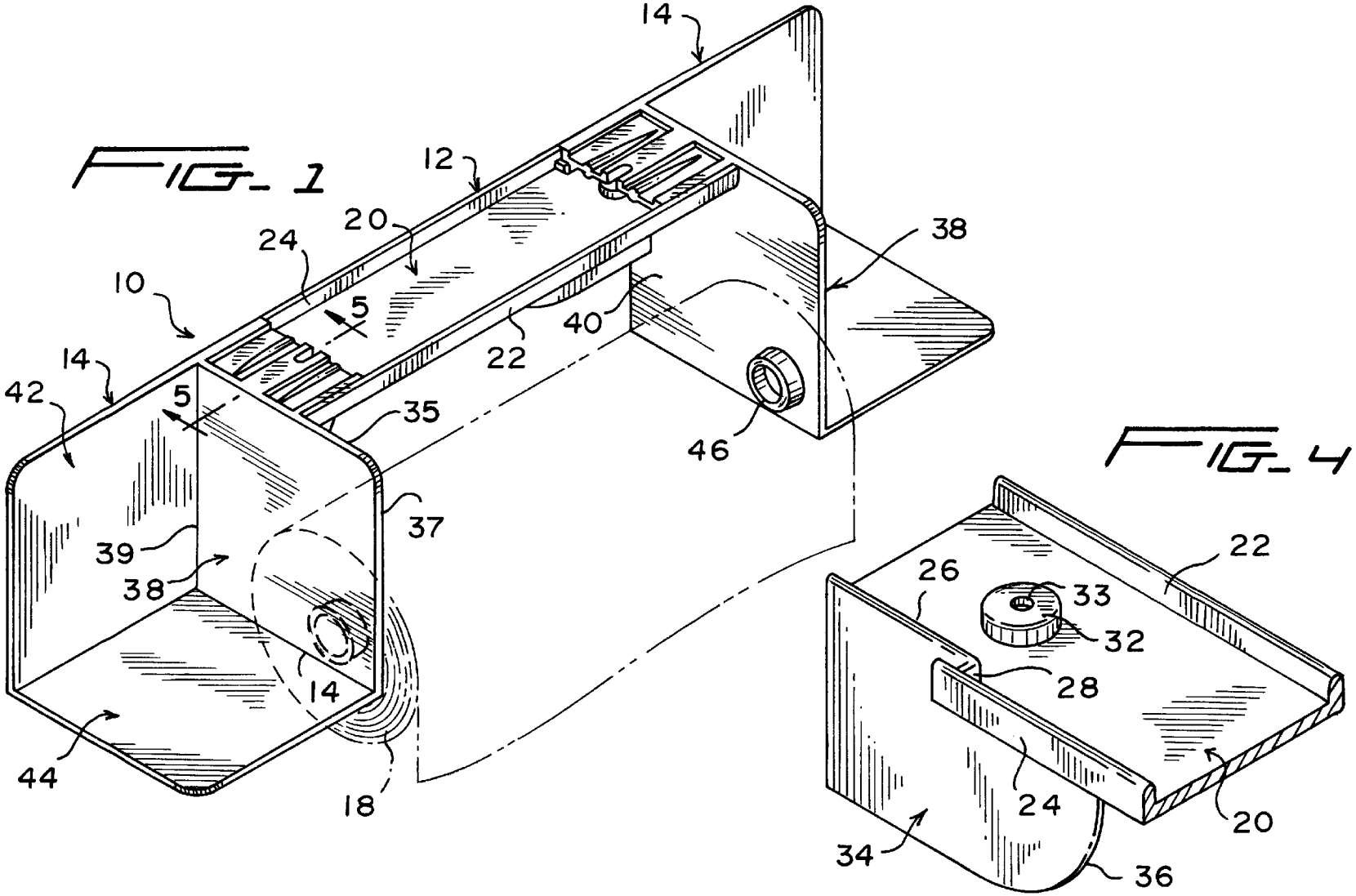
FIG. 1 is a perspective view of the holder of the invention assembled for mounting on a overlying horizontal surface.
FIG. 4 is a rear perspective detail of an end portion of the base.
Figures 2, 3:
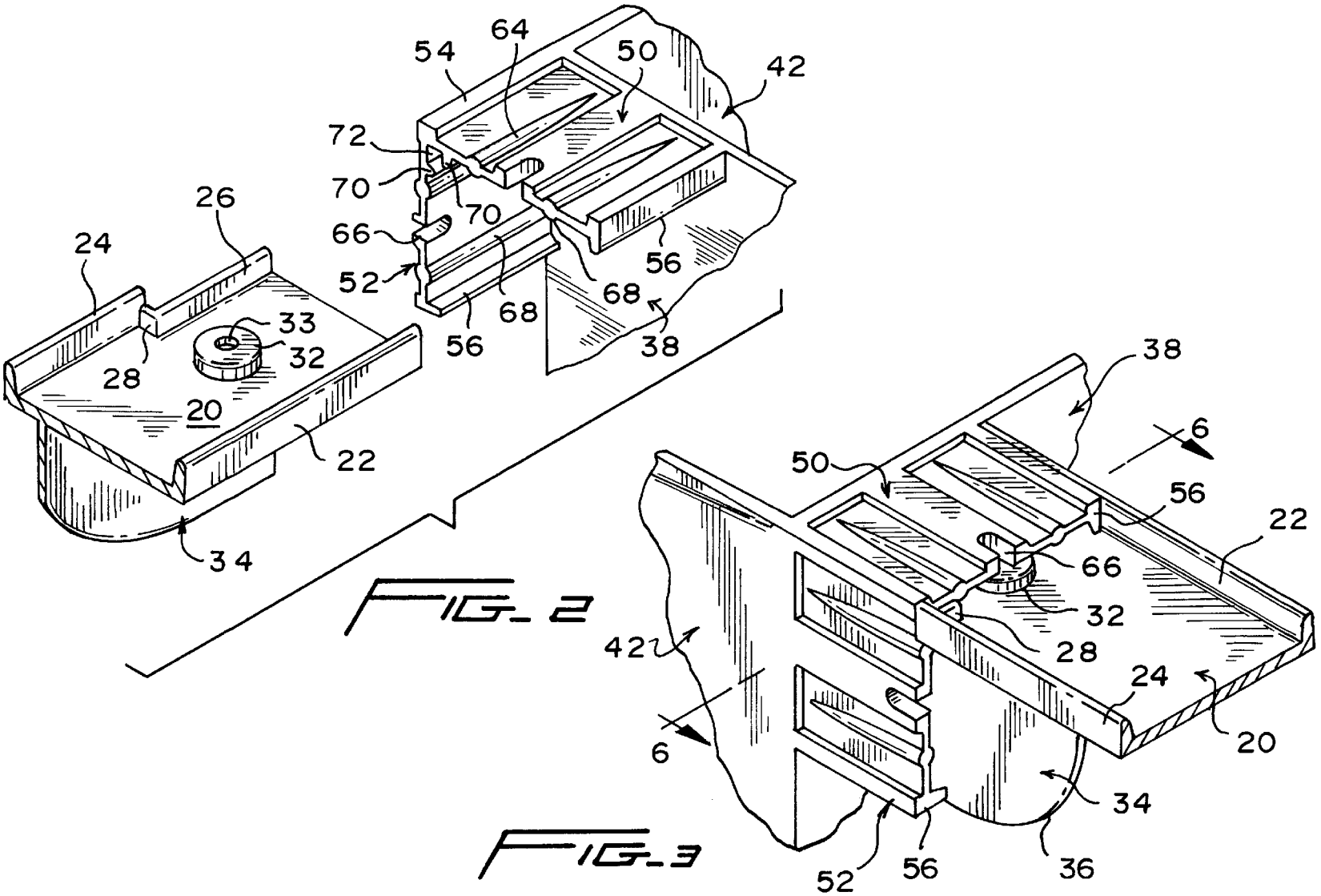
FIG. 2 is an exploded front perspective detail of the right end portion of the base and the bracket portion of the corresponding end support.
FIG. 3 is a rear perspective detail of the assembled components of FIG. 2.
Figure 6:
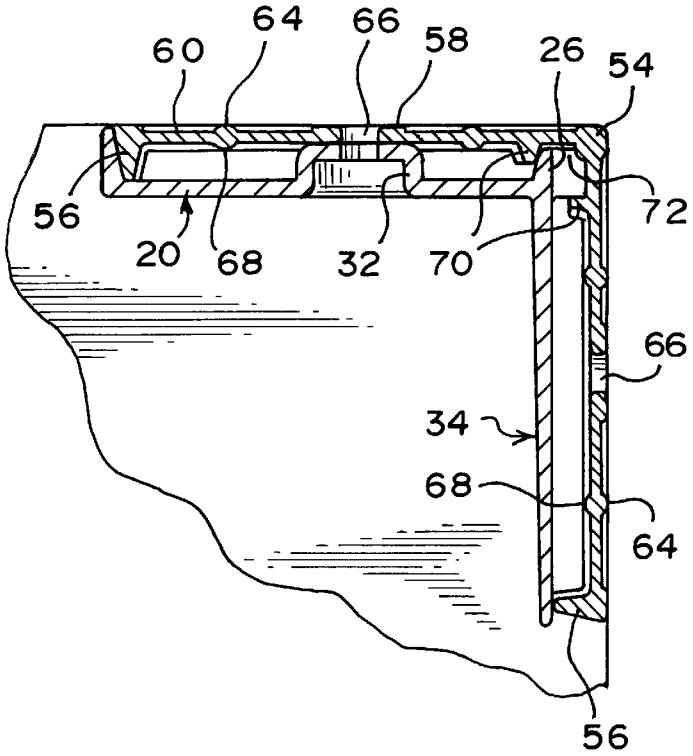
FIG. 6 is an enlarged cross-sectional detail taken substantially on a plane passing along line 6—6 in FIG. 3.

Noting FIGS. 2, 3 and 6 in particular, the brackets 48 are slidably and telescopically engaged with the opposed end portions of the base 12. The top or horizontal panel of each bracket 48 overlies the corresponding end portion of the base top panel 20 with the base front flange 22 receiving the bracket panel flange 56 immediately inward thereof. The rear flange 26 of each end portion of the base 12 is slidably received below the corresponding top bracket panel 50 and within the retaining groove 72 between the rear bracket panel 52 and the forwardly spaced retaining flange 70 depending from the top panel 50 of the respective bracket.

Each depending rear bracket panel 52 is positioned behind, and engaged and concealed by the corresponding rear base stabilizing panel 34. Further, when each end portion of the base 12 is fully telescopically engaged with the corresponding bracket 48, the outer free end of the corner rib 54 of the bracket will engage against the turned end portion 28 of the adjacent flange 26. The depth of the rear recess 30 at each end portion of the base 12 is sufficient to accommodate the thickness of the rear bracket panel 52 for a general coplanar alignment of the rearmost faces of the brackets 48, end supports 14 and base 12. The mounted paper roll 18 will be easily accessible in that the mounting hubs or stub shafts 46 are positioned substantially forward of the rear face of the holder and an appreciable distance below the top plane of the holder.

It will also be noted that each of the screw-receiving bosses 32 aligns beneath the corresponding bracket panel slot 66. Thus, upon a mounting of the holder utilizing upwardly driven fasteners, the opposed brackets 48 will be effectively clamped between the upwardly fixed base 12 and an overlying support surface. The elongate slot in the two horizontal engaged bracket panels 50 allow, in an obvious manner, a slight degree of longitudinal adjustment between the end supports 14.

It is contemplated that sufficient inherent flexible resiliency reside in the holder structure, and in particular the end supports 14 and the facing side walls 38 thereof, to allow for a mounting and removal of the roll 18. Also, as will be recognized, the conventional paper roll itself includes a degree of resilient softness which will facilitate mounting and removal. Should sheet material of a particularly rigid nature be involved, mounting can always be effected by a slight loosening of the fasteners or screws to allow for an outward shifting of the end supports 14 and a subsequent inward re-engagement after the roll is positioned. This would not normally be necessary.

Figures 7, 8:
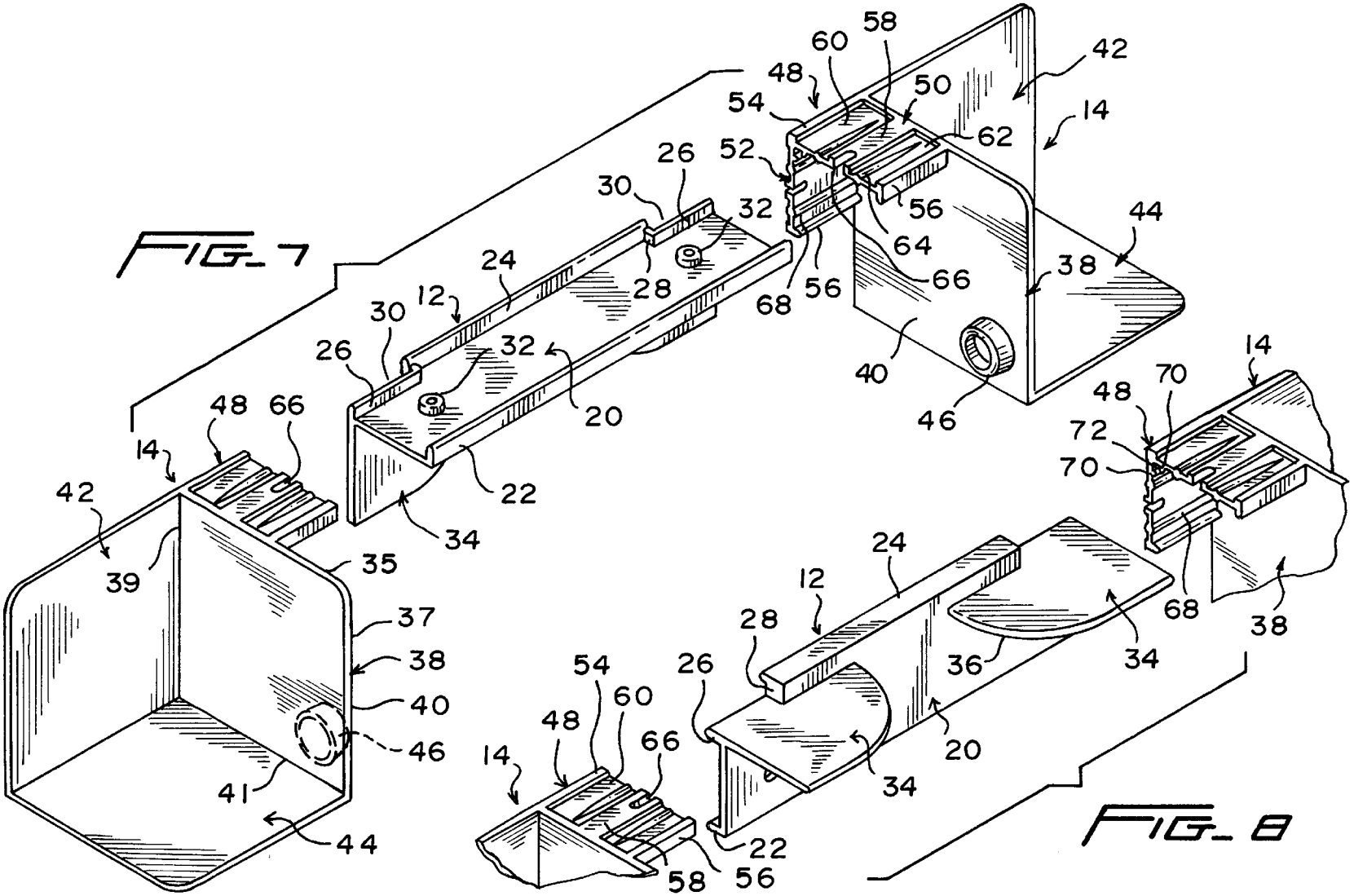
FIG. 7 is an exploded perspective view of the three components of the invention with the base oriented for securement to an overlying horizontal surface.
FIG. 8 is an exploded perspective view of portions of the end supports with the base inverted relative to FIG. 7 for mounting on a vertical surface.

Referring now particularly to FIG. 8, should it be desirable to mount the holder on a vertical wall surface, the base 12 can be turned end-for-end and rotated 90 degrees to position the coplanar panels 34 horizontally, and the prior top mounting panel 20 vertically in the nature of a rear mounting panel.

After a repositioning of the base 12, engagement of the end portions of the base 12 with the brackets 48 is much as described above. The now horizontal panels 34 immediately underlie and engage the bracket top panels 50 and with the end portions of the mounting panel 20 engaging immediately inward of the vertical bracket panels 52. This relationship can best be appreciated by visualizing the cross-section of FIG. 6 rotated 90 degrees toward the left. In this position, the bosses 32 are positioned vertically and aligned with the slots or notches 66 in the vertical rear bracket panel 52 of the brackets 48 for a mounting of the holder on a vertical surface.

The foregoing is illustrative of the preferred embodiment of the invention, and as other embodiments incorporating the inventive features of the invention may occur to those skilled in the art, the disclosed embodiment is not to be considered as a limitation on the scope of the invention. Rather, the invention is only to be limited by the scope of the claims following hereinafter.

I claim:

1. A holder for a roll of paper comprising a mounting base and a pair of spaced end supports, said base being elongate and including opposed end portions, each of said end supports including a side member, said end supports being positioned with said side members facing inwardly toward each other with said base therebetween, a bracket fixed to each side member, the brackets extending inwardly toward each other and being slidably mounted on said opposed end portions of said base for support of said brackets and said end supports by said base, each of said side members having an inwardly facing hub, said hubs being in aligned facing relation with each other for mounting engagement with a roll of paper received therebetween, said base being provided with means for mounting in a first position to a horizontal surface and in a second position perpendicular thereto for mounting to a vertical surface, each of said brackets being removably mounted on the respective end portion of said base in each of said first and second positions of said base, each said bracket comprising two bracket panels fixed to the corresponding side member and positioned substantially perpendicular to each other, said bracket panels defining a first pair of aligned bracket panels, one on each end support, and a second pair of aligned bracket panels, one on each end support, said base including an elongate mounting panel, and stabilizing panel means extending substantially perpendicular to said mounting panel for stabilizing said base relative to said end supports, said mounting panel in said first position engaging said first pair of aligned bracket panels, one on each end support, and said stabilizing panel means engaging said second pair of bracket panels, one on each end support, said mounting panel in said second position engaging said second pair of aligned bracket panels, one on each end support, said stabilizing panel means engaging said first pair of aligned bracket panels, one on each end support, each end support having a shelf member rigid with the corresponding side member, and said shelf member being retained horizontal in said first position and said second position of said base.

2. The holder of claim 1 wherein each of said end supports includes a shelf member extending substantially perpendicular from the corresponding side member to an opposite side thereof from the corresponding bracket.

3. The holder of claim 2 wherein said side members of said end support each include an upper edge, a rear edge, a front edge and a bottom edge, said bracket panels of each bracket extending from the corresponding side member parallel to and adjacent said upper and rear edges respectively of the corresponding side member, each of said bracket panels being of a transverse width less than the length of the respective edge, said hubs being positioned adjacent said front edges of said respective side members.

4. The holder of claim 3 wherein said mounting panel of said base includes a pair of fastener receiving transverse apertures therethrough, every one of said bracket panels including a free outer edge remote from the corresponding side member, a notch centrally along each said free outer edge, each notch aligning with a corresponding one of said apertures for accommodation of a driven fastener therethrough.

5. The holder of claim 4 wherein said two panels of each bracket are joined along a common elongate edge extending perpendicular to the corresponding side member and defining a corner rib, an elongate retaining flange on each bracket panel paralleling the corresponding corner rib in laterally spaced relation thereto and defining a receiving groove therebetween, each of said end portions of said base having a longitudinally extending flange thereon received within a receiving groove of the adjacent bracket.

6. The holder of claim 5 wherein each bracket panel includes an outer front edge with a flange therealong parallel to said corner rib, said mounting panel of said base including a longitudinally extending edge with a perpendicularly extending flange defined thereat, said base edge flange engaging along said flanged edge of each one of said pairs of bracket panels.

7. The holder of claim 6 including multiple reenforcing ribs integrally formed with each bracket panel perpendicular to the respective side member.

* * * * *